US008910417B1

(12) United States Patent
Meyers

(10) Patent No.: US 8,910,417 B1
(45) Date of Patent: Dec. 16, 2014

(54) CUT FLOWER CONTAINER

(76) Inventor: Douglas Reid Meyers, Minneapolis, MN (US)

( * ) Notice: Subject to any disclaimer, the term of this patent is extended or adjusted under 35 U.S.C. 154(b) by 384 days.

(21) Appl. No.: 13/549,451

(22) Filed: Jul. 14, 2012

(51) Int. Cl.
*A47G 7/00* (2006.01)

(52) U.S. Cl.
USPC ..... 47/41.01; 47/58.1 CF; 47/67; 206/423; 248/318; 248/323

(58) Field of Classification Search
USPC ..... 206/423, 806; 47/41.01, 41.11–41.15, 47/58.1 CF, 65.7, 66.7, 67, 84; 53/431, 53/473, 474; 220/752, 754, 757; 248/317, 248/318, 323, 328
See application file for complete search history.

(56) References Cited

U.S. PATENT DOCUMENTS

| | | | | | |
|---|---|---|---|---|---|
| D5,406 | S | | 12/1871 | Runey | |
| D50,329 | S | | 2/1917 | White | |
| 1,226,101 | A | | 5/1917 | Marsden | |
| D56,006 | S | | 8/1920 | Kenner | |
| 1,566,794 | A | | 12/1925 | Harper | |
| 1,627,649 | A | | 5/1927 | Karabin et al. | |
| 1,712,066 | A | | 4/1929 | Baron | |
| 1,951,642 | A | * | 3/1934 | Augustin et al. | 47/67 |
| 2,330,878 | A | * | 10/1943 | Foley | 47/84 |
| 2,774,187 | A | | 12/1956 | Smithers | |
| 3,073,062 | A | | 1/1963 | Hoffman | |
| 3,498,520 | A | | 3/1970 | Zumpel et al. | |
| 3,973,356 | A | | 8/1976 | Schacht | |
| 4,091,925 | A | | 5/1978 | Griffo et al. | |
| 4,220,305 | A | | 9/1980 | Pollard | |
| 4,248,347 | A | | 2/1981 | Trimbee | |
| 4,534,130 | A | | 8/1985 | Rogers | |
| 4,605,191 | A | | 8/1986 | Kagan | |
| 4,669,693 | A | * | 6/1987 | Kagan | 248/318 |
| 4,801,014 | A | * | 1/1989 | Meadows | 206/423 |
| 4,875,653 | A | | 10/1989 | Connolly | |
| 5,077,936 | A | * | 1/1992 | Beaven | 47/67 |
| 5,509,251 | A | | 4/1996 | Weder et al. | |
| 5,779,210 | A | * | 7/1998 | Canson et al. | 248/318 |
| D424,471 | S | | 5/2000 | Souris | |
| 6,129,209 | A | | 10/2000 | Tchira | |
| 6,665,982 | B1 | | 12/2003 | Van Wingerden | |
| 6,712,209 | B2 | * | 3/2004 | Story | 206/423 |
| 6,758,010 | B2 | | 7/2004 | Wright | |
| 6,915,606 | B2 | | 7/2005 | Lantier et al. | |
| 7,032,347 | B2 | * | 4/2006 | Hartman | 47/67 |
| D565,964 | S | | 4/2008 | Feenstra | |
| 2003/0047474 | A1 | | 3/2003 | Dahlson | |
| 2004/0011687 | A1 | | 1/2004 | Charrin et al. | |
| 2007/0089361 | A1 | * | 4/2007 | Weder | 47/41.01 |
| 2008/0241445 | A1 | | 10/2008 | Medeiros Santos et al. | |
| 2010/0170153 | A1 | * | 7/2010 | Weder | 47/58.1 CF |
| 2012/0048761 | A1 | | 3/2012 | Ginjo | |

* cited by examiner

*Primary Examiner* — Luan K Bui
(74) *Attorney, Agent, or Firm* — Berggren Law Offices, LLC; William R. Berggren

(57) ABSTRACT

A container for transporting and displaying cut flowers comprising six elements. A material of the apparatus is substantially deformable and dishwasher safe. A base, top and sides are constructed to hold cut flowers and water and the top has at least a first and a second affixing element equidistant from each other on opposite ends of the perimeter. A bottom member suspends below the base. A carrying element has an adjustable functional length with a first and second functional end, a first and second actual end that can extend beyond each functional end, and a first and second attachable elements between the respective first and second actual end and the corresponding nearest functional end to each, the attachable element able to be removably attached at various lengths to the respective first and second affixing element for transport and attachment to a suspending element.

20 Claims, 10 Drawing Sheets

CUT FLOWER CONTAINER

FIELD OF THE INVENTION

This invention relates to a hanging container and a method for transporting and displaying cut flowers.

BACKGROUND OF THE INVENTION

There is a need to an apparatus and method for transporting and displaying cut flowers.

Cut flowers out of water will wilt and die quickly. Preferably, cut flowers should be out of water no longer than 30 minutes. Presently, cut flowers typically are transported in paper or clear flexible sheet plastic wrappings or bags, sometimes with vials of water for each stem. Sometimes flowers are transported in a hard to carry, handle-less, container, typically glass or hard plastic, with water.

There still is a need for a way to transport and display cut flowers in a manner that permits them to be out of water for less than 30 minutes, preferably for less than 5 minutes, and more preferably for less than a minute. In addition, there still is a need for a better way to transport and display cut flowers, particularly on balcony railings and support beams in homes interiors and exteriors and on porch railings.

SUMMARY OF THE INVENTION

I have invented a floral container for transporting and displaying cut flowers in water comprising six elements, a material, a base, a top, sides, a bottom member and a carrying element. The material of the apparatus is substantially deformable, unbreakable, moisture-resistant, weatherproof and dishwasher safe. The base has a bottom surface and a first horizontal perimeter with an axis passing vertically through the center of the shape defined by the perimeter. The top is open, has a second horizontal perimeter and comprises at least a first and a second affixing element where the first and second affixing elements are substantially equidistant from each other on opposite ends of the perimeter. The sides, affixed to both the base and top, have a horizontal perimeter ranging in length from a constant between the base and the top to an amount that increases between the base and the top to one that varies in length between the base and top. The bottom member is affixed to the base and suspended below the bottom surface. The carrying element has an adjustable functional length of between 15 inches and 50 inches with a first functional end and a second functional end. The carrying element also has a first actual end and a second actual end that can extend beyond each end of the functional length, and a first attachable element between the first actual end and the first functional end that can be removably attached to the first affixing element of the top. The carrying element also has a second attachable element that has two positions. A first position is between the second actual end and the nearest functional end that can be removably attached at various lengths to the second affixing element of the top. A second position is between a fixing element other than the first affixing element and the second actual end after the carrying element is wrapped around a suspending element to place the container securely against the suspending element.

I have also invented a method for transporting and displaying cut flowers in water comprising five steps. First, provide the container described above. Second, place a selection of cut flowers and at least some water into the container. Third, affix the carrying element to at least the first and second affixing element with the first and second attachable elements to leave a suitable functional length to avoid adversely contacting the flowers while carrying the container by its carrying element. Fourth, transport the container with cut flowers to a display location. Fifth, display the container with the cut flowers in water at the display location.

My easily transportable vase will ensure cut flowers are essentially continuously hydrated from the time one leaves a florist shop to when the flowers are no longer fresh enough to display, except during brief times when water is being changed, if desired. Thus, as cut flowers are being transferred at the florist into the container, they will be out of water for less than thirty (30) minutes, preferably for less than five (5) minutes, and more preferably for less than one (1) minute. The unbreakable, deformable flower container keeps cut flowers in water directly from the florist or garden, thus ensuring the health of the bouquet for a longer time. The presence and position of the attaching and affixing elements permit the container to be mounted securely to a variety of surfaces inside and outside a residence or commercial building, or inside a vehicle.

As used herein,

"Dishwasher-safe" means that it will not change color or flexibility or shape through softening and melt flowing when exposed to the temperatures and detergent in a typical residential dishwasher.

"Deformable" means a material that is able to have its shape substantially changed by the squeezing action of a pair of hands of an average person.

"Moisture impervious" means that no water will pass through the material when in contact for at least 90 days.

"Suspending element" means (1) a horizontal railing from such building construction elements as, for example, a porch or landing, (2) an angled railing from such building construction elements as, for example, stairs or ramps; or (3) vertical beams from such building construction elements as, for example, vertical supporting beams or decorative beams for landings, stairs, porches or upper floors.

"Unbreakable" means that the container will not break if dropped onto a concrete surface from a distance of at least ten feet at a temperature of thirty-two (32) degrees Fahrenheit (F).

"Weatherproof" means that the container will not discolor or lose its deformability or unbreakable nature when exposed to temperatures ranging from twenty (20) degrees F. to one hundred and twenty (120) degrees F., relative humidity from five (5) percent relative humidity to one hundred (100) percent, and exposure to the ultraviolet radiation from sunlight for a prolonged exposure of at least six (6) months.

BRIEF DESCRIPTION OF THE DRAWINGS

One or more features or preferred forms of the invention are described in the accompanying drawings. The drawings are described briefly below.

DETAILED DESCRIPTION OF SOME EMBODIMENTS OF THE INVENTION

Figure 1:
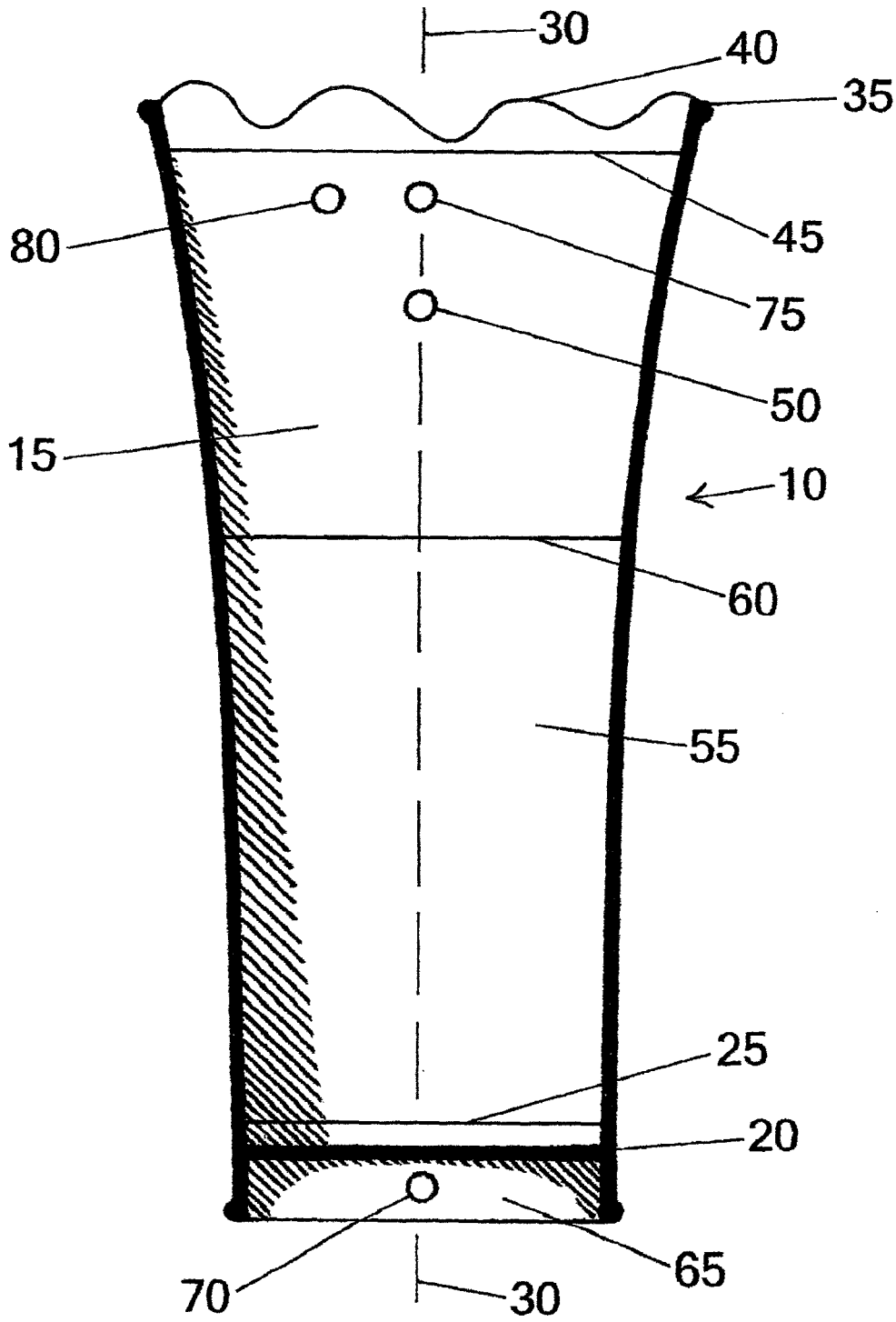
FIG. 1 is a front view of one embodiment with a rim and a top edge that is not horizontal.

My invention is a container designed to both transport cut flowers in water and display them in a variety of places including, for example, on tables and from suspending elements. Suspending elements are (1) a horizontal railing from such building construction elements as, for example, a balcony, porch, deck or landing, (2) an angled railing from such building construction elements as, for example, stairs or ramps; or (3) vertical beams from such building construction elements as, for example, vertical supporting beams or decorative beams for landings, stairs, porches or upper floors.

My container comprises six elements, a material, a base, a top, sides, a bottom member and a carrying element. A material of the container is substantially deformable and dishwasher safe. A base, top and sides are constructed to hold cut flowers and water and the top has an edge and at least a first and a second affixing element equidistant from each other on opposite ends of the perimeter. A bottom member suspends below the base. A carrying element has an adjustable functional length with a first and second functional end and a first and second actual end that extend beyond each functional end. The carrying element also has a first and second attachable element between the respective first and second actual end and the corresponding nearest functional end to each. The attachable element can be removably attached at various lengths to the respective first and second affixing element for transport and attachment to suspending elements. A method of using the container is also presented.

The material of the container has several properties. It is substantially deformable and dishwasher safe. It is also unbreakable, moisture-resistant, and weatherproof. The deformable property allows the container to intimately press against a surface such as a flat vertical beam to remain in a secure stable position for many days until the cut flowers are no longer fresh enough to be displayed. The dishwasher safe property allows the apparatus to be cleaned easily in a dishwasher. The unbreakable property allows the apparatus to remain intact and keep its shape if dropped onto a cement floor from heights of ten, twenty or thirty feet at a temperature of 32 degrees Fahrenheit for different embodiments. The moisture-resistant property allows the apparatus to contain water for as long as necessary, often over several months. The weatherproof property allows the container to perform as a display container outside for as long as necessary, often over several months, without substantially any change in properties. One material that has the desired properties is silicone polymer. Others are known in the art.

A base, top and sides of the container are constructed to hold cut flowers and water. The base has a bottom surface and a first horizontal perimeter with an axis passing vertically through the center of the shape defined by the perimeter. The top is open, has an edge, a second horizontal perimeter proximate the edge and comprises at least a first and a second affixing element where the first and second affixing elements are substantially equidistant from each other on opposite ends of the perimeter. The edge may or may not be substantially horizontal. The sides, affixed to both the base and top, have a horizontal perimeter ranging in length from a constant between the base and the top to an amount that increases between the base and the top to one that varies in length between the base and top.

Embodiments of the container have various shapes. The substantially horizontal perimeter is from a group consisting of a triangle, square, rectangle, polygon, circle and oval. Thus, the shape may be not only functional to transport cut flowers but also decorative for the attractive display of cut flowers.

A bottom member suspends below the base. The bottom member is affixed to the base and suspended below the bottom surface. In some embodiments, the bottom member is a lip, affixed to the periphery of the base that extends from the sides below the base and has a vertical length. In these embodiments, the container also has a bottom edge and at least three sections that are substantially equidistant from each other along the horizontal perimeter of the base. This allows the container to be set upright on a horizontal surface. In other embodiments, the lip is continuous around the horizontal perimeter of the base and the sections are unified. This allows for stable display on a horizontal surface with a container constructed of more deformable material. In still other embodiments, the bottom member is a flange that is affixed to the bottom surface of the base. In other embodiments, the bottom member is both a flange and a rim, and the flange is foldably attached to the base to permit the flange to fold within the rim and the container to be displayed on a horizontal surface.

In other embodiments, the bottom member has a third affixing element vertically aligned with a first affixing element and the carrying element has at least a third attachable element that can be removably attached at various lengths to the third affixing element of the bottom member. In some embodiments, the rim has the third affixing element attached thereto. In other embodiments, the flange has the third affixing element. In still other embodiments, the bottom member is an attaching element such as, for example, a hook or shaped protrusion suitable for attachment purposes.

A carrying element has an adjustable functional length for optimum transport of cut flowers and an adjustable length for displaying cut flowers on a suspending element. The carrying element has an adjustable functional length of between 15 inches and 50 inches with a first functional end and a second functional end. A first actual end and a second actual end most often extend beyond each end of the functional length. A first attachable element between the first end and the first functional end can be removably attached at various lengths to the first affixing element of the top. A second attachable element has two positions. The first position is between the second actual end and the nearest functional end that can be removably attached at various lengths to the second affixing element of the top. The second position is between a fixing element other than the first affixing element and the second actual end after the carrying element is wrapped around a suspending element to place the container securely against the suspending element.

The carrying elements, attaching elements and affixing may have different forms as long as their function is as described above. In some embodiments, the carrying element is a chain, the attaching elements are the links of the chain and the affixing elements are hooks or protrusions that can engage the loops in a stable holding manner. In these embodiments, the protrusions may be directed toward the axis or away from the axis. In some embodiments, the links are each considered an attaching element. Thus, there may be three attaching elements if the second and third attaching element involve a different link. In some embodiments, the links engaged with the affixing elements are considered the attaching elements. Thus, only two attaching elements are engaged at any one time.

In some embodiments, the carrying element is a cord, the attaching elements reposition stops such as, for example, spring-loaded slideable connectors and the affixing elements are holes that the cord passes through. In these latter embodiments, the second and the third attachable element are the same.

The functional length is that adjustable length used for transporting the vase and begins proximate the first affixing element and ends proximate the second affixing element. This length is between 15 and 50 inches. Some embodiments have a functional length of between 24 and 45 inches. Some embodiments have a functional length of between 30 and 40 inches. In embodiments where the carrying element is a chain, the length between the function ends and the actual ends can be the same.

In some embodiments, the top of the container further comprises at least a fourth affixing element substantially vertically displaced from and proximate the first affixing element and/or a fifth affixing element at least substantially horizontally displaced from and proximate the first affixing element. In addition, the fifth affixing element may be somewhat vertically displaced from the first affixing element as well. In some embodiments, the fifth affixing element may be more horizontally aligned with affixing elements other than the first affixing element but is horizontally displaced in at least some measure from the first affixing element. "Substantially proximate" means from 0.5 inch to 3 inches, or from 0.5 to 2.0 inches for different embodiments. In some embodiments, additional affixing elements may be proximate the first affixing element such as, for example, an affixing element on the opposite side of first affixing element from the fourth affixing element. This would provide a more symmetrical arrangement of affixing elements. In some embodiments, the affixing elements around the first affixing element may be duplicated around the second suffixing element for symmetry. These additional affixing elements permit the container to be attached in a more secure manner to a suspending element, even to the point of distorting the flexible container against the suspending element.

In some embodiments, the top of the container further comprises at least a sixth affixing element substantially vertically displaced from and proximate the second affixing element and a seventh affixing element at least substantially horizontally displaced from and proximate the sixth affixing element. These permit the container to be attached in a more secure manner to a suspending element. In addition, these permit for carrying purposes a carrying element such as a cord to pass into the container through a fourth and sixth affixing element, such as a hole, and out of the container through affixing elements first and second or fifth and seventh to a first and second attaching element. Thus, the attaching elements are outside the container and the cord is outside the container as it is raised to permit carrying of the container. This better protects the cut flowers from adverse pressure by the carrying element.

I have also invented a method for transporting and displaying cut flowers in water comprising five steps. First, provide the apparatus described above. Second, place a selection of cut flowers and at least some water into the container. Third, affix the carrying element to at least the first and second affixing element with the first and second attachable elements to leave a suitable functional length to avoid adversely contacting the flowers while carrying the container by its carrying element. Fourth, transport the container with cut flowers to a display location. Fifth, display the container with the cut flowers in water at the display location.

The display location may be any constructed element commonly found inside or outside a residential or commercial construction. These locations include, for example, a substantially horizontal surfaces and a suspending surface as previously described.

In some embodiments of the method, the container provided has additional features from that described and additional steps are used. The bottom member has at least a third affixing element, the carrying element has a third attachable element that can be removably attached at various lengths to the third affixing element of the lip and the display location has a suspending element. The displaying step of the method first described earlier further comprises three steps. The sixth step is removing at least the second end of the carrying element from the second affixing element. The seventh step is wrapping the carrying element at least once around the suspending element. The eighth step is affixing the carrying element to the third affixing element with the third attachable element to hold the container securely in a desired position. This method is particularly suitable for suspending elements that are substantially horizontal or angled.

In some embodiments of the method, the container provided has additional features from that described and additional steps are used. The top further comprises a fourth affixing element substantially horizontally proximate the first affixing element and a fifth affixing elements substantially vertically proximate the first affixing element. The displaying step of the method first described above further comprises three steps. The ninth step is removing at least the second end of the carrying element from the second affixing element. The tenth step is wrapping the carrying element at least once around the suspending element. The eleventh step is affixing the carrying element to at least the fourth or fifth affixing element with the third attachable element to hold the container securely in a desired position. This method is particularly suitable for suspending elements that are substantially vertical or angled.

In some embodiments of the method, the container provided has additional features from that described in claim 14 and additional steps are used. The bottom member has a third affixing element and the top further comprises a fourth affixing element substantially horizontally proximate the first affixing element and a fifth affixing element substantially vertically proximate the first affixing element. Also, the carrying element has at least a third attachable element that can be removably attached at various lengths to the third affixing element of the bottom member. In addition, the display location has a suspending element. The displaying step of the method described in claim 14 further comprises three steps. The twelfth step is removing at least the second end of the carrying element from the second affixing element. The thirteenth step is wrapping the carrying element at least once around the suspending element. The fourteenth step is affixing the carrying element to the affixing element other than the first affixing element with the third attachable element to hold the container securely in a desired position.

In some embodiments of the method, the container is pressed firmly against the suspending element with some distortion of the sides of the container to secure a secure position of the container against the suspending element before the carrying element is wrapped around the suspending element. This is particularly beneficial when the carrying element is removably attached, after being wrapped around a suspending element, to at least two affixing elements that are vertically displaced and the suspending element is substantially horizontal or angled. Alternatively, the deformity is particularly beneficial when the carrying element is removably attached, after being wrapped around a suspending element, to at least two affixing elements that are horizontally displaced and the suspending element is substantially vertical or angled.

FIGS. 1 through 10 depict five embodiments of my invention. Similar elements designated with the same numbers. FIG. 1 depicts a first embodiment. It is a front view of the embodiment with a rim as the bottom member. The container (10) is made of the material (15). The base (20) has a bottom surface (not seen) and a first horizontal perimeter (25) with an axis (30) passing vertically through the center of the shape defined by the perimeter. The top (35) is open, has an edge (40), a second horizontal perimeter (45) and comprises at least a first affixing element (50) (a hole) and a second (not shown) affixing element substantially equidistant from each other on opposite ends of the perimeter. The sides (55) have a third horizontal perimeter (60) that increases between first horizontal perimeter 25 and second horizontal perimeter 45. The bottom member (65) is a rim, affixed to base 20 and suspended below the bottom surface of base 20, contains the third affixing element (70). Top 35 also contains a fourth affixing element (75) vertically displaced from and proximate to first affixing element 50, a fifth affixing element (80) at least horizontally displaced from and proximate to first affixing element 50.

Figure 2:
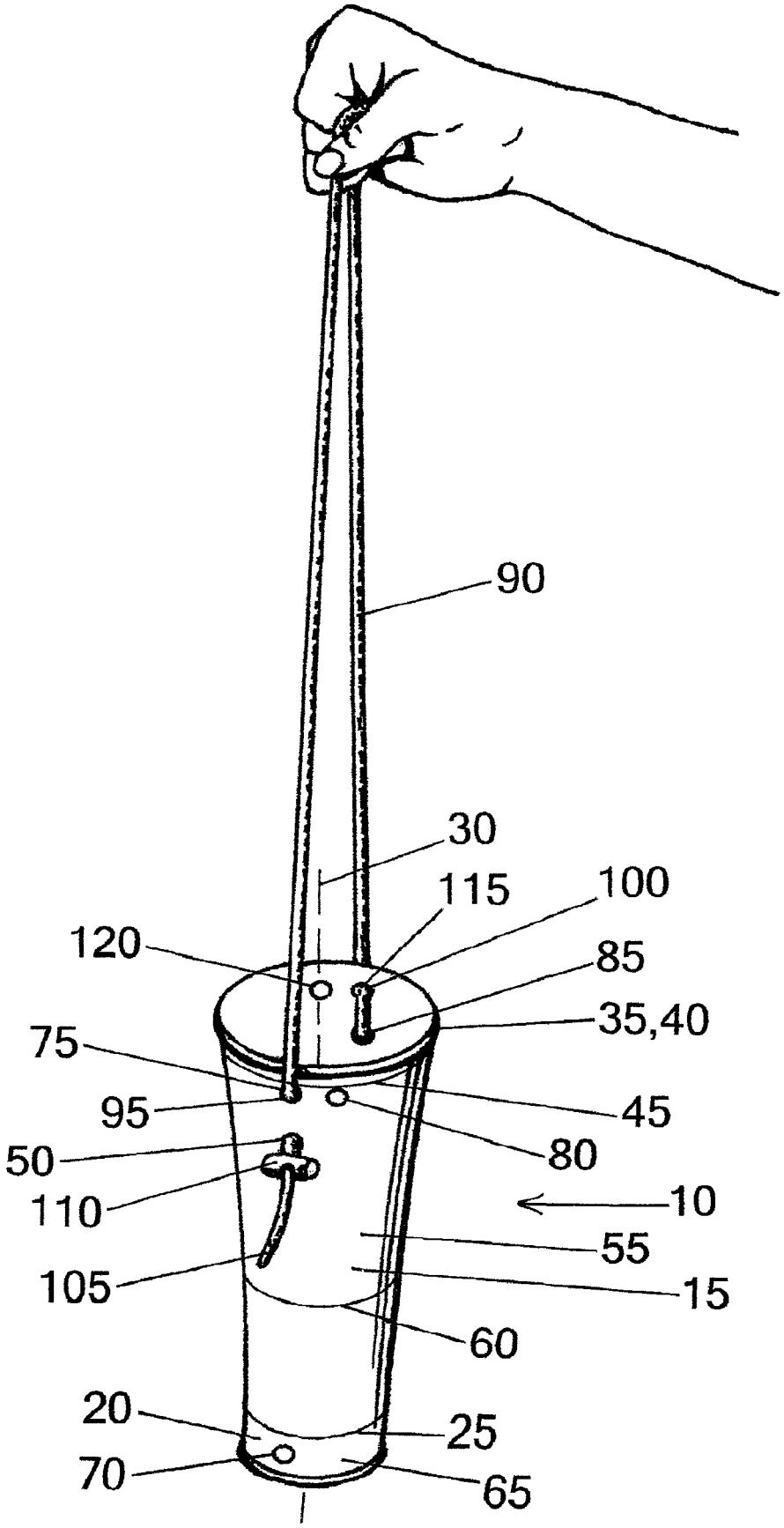
FIG. 2 is a perspective view of a second embodiment being carried empty and with a substantially horizontal top edge.
Figure 3:
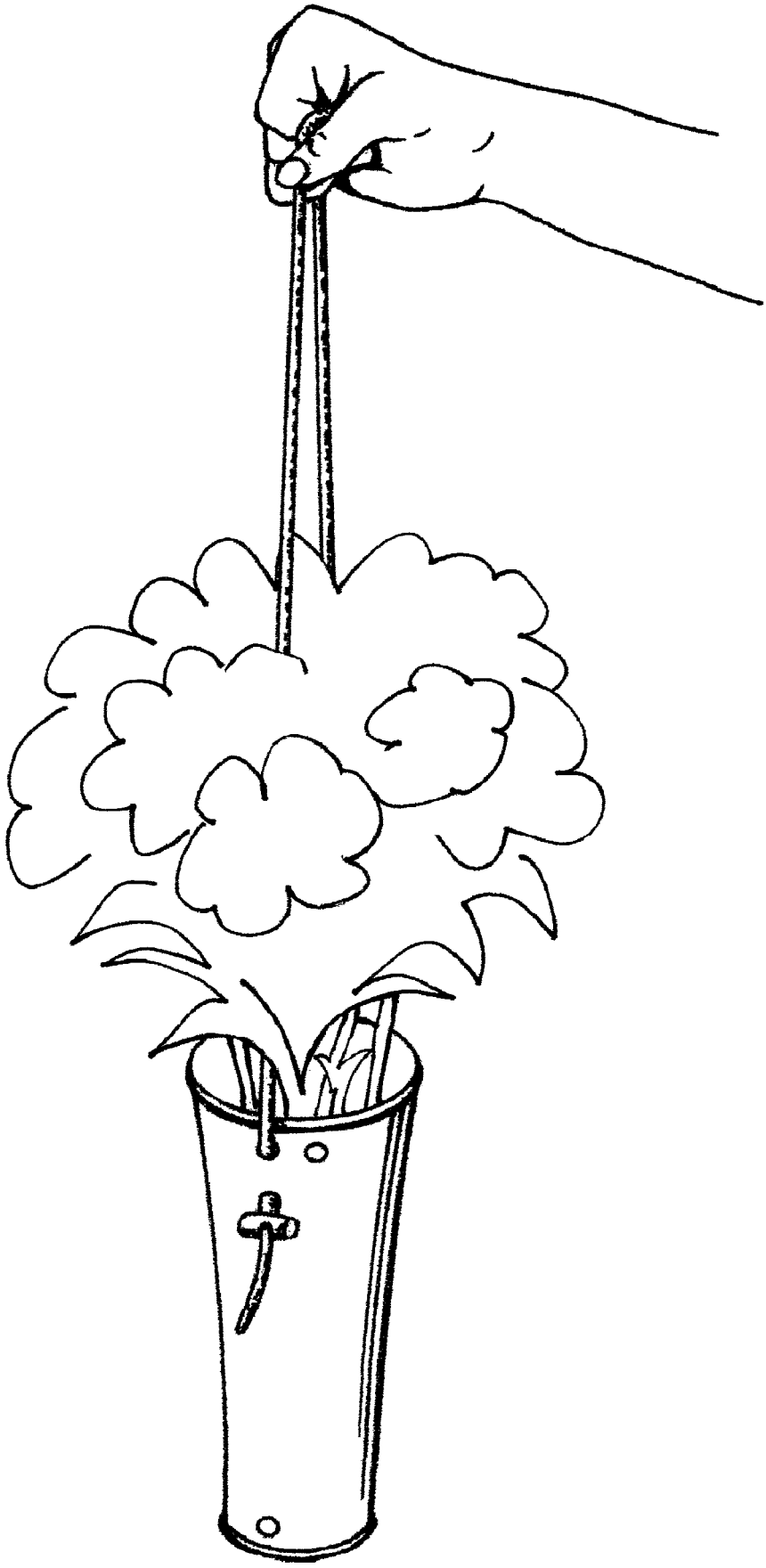
FIG. 3 is a perspective view of the embodiment of FIG. 2 being carried with cut flowers.

FIGS. 2 and 3 depict a second embodiment. The horizontally displaced affixing elements in the top are reversed in position from those depicted in FIG. 1. FIG. 2 is a perspective view of a second embodiment being carried empty and with a substantially horizontal top edge. Container 10 is made of material 15. Base (not seen) has a bottom surface (not seen) and a first horizontal perimeter with axis 30 passing vertically through the center of the shape defined by the perimeter. Top 35 is open, has edge 40, second horizontal perimeter 45 and comprises at least first affixing element 50 and a second affixing element (85) substantially equidistant from each other on opposite ends of the perimeter. Sides 55 have third horizontal perimeter 60 that increases between first horizontal perimeter 25 and second horizontal perimeter 45. Bottom member 65 is a rim, affixed to base 20 and suspended below the bottom surface of the base (not shown), contains third affixing element 70. The carrying element (90), a cord, has an adjustable functional length with a first functional end (95) and a second functional end (100) and a first actual end (105) and a second actual end (not shown) that extend beyond each end of the functional length. Carrying element 90 also has a first attachable element (110) between first functional end 95 and first actual end 105 that can be removably attached at various lengths to first affixing element 50 of the top. In addition, carrying element 90 has a second attachable element (not shown) between the second end (not shown) and second functional end 100 that is able to be removably attached at various lengths to second affixing element 85 of top 35. Top 35 also contains fourth affixing element 75 vertically proximate to first affixing element 50, fifth affixing element 80 at least horizontally displaced from and proximate to first affixing element 50. In addition, top 35 contains a sixth affixing element (115) vertically proximate to second affixing element 85, a seventh affixing element (120) at least horizontally displaced from and proximate to second affixing element 85.

FIG. 3 is a perspective view of the embodiment of FIG. 2 being carried with cut flowers.

Figure 4:
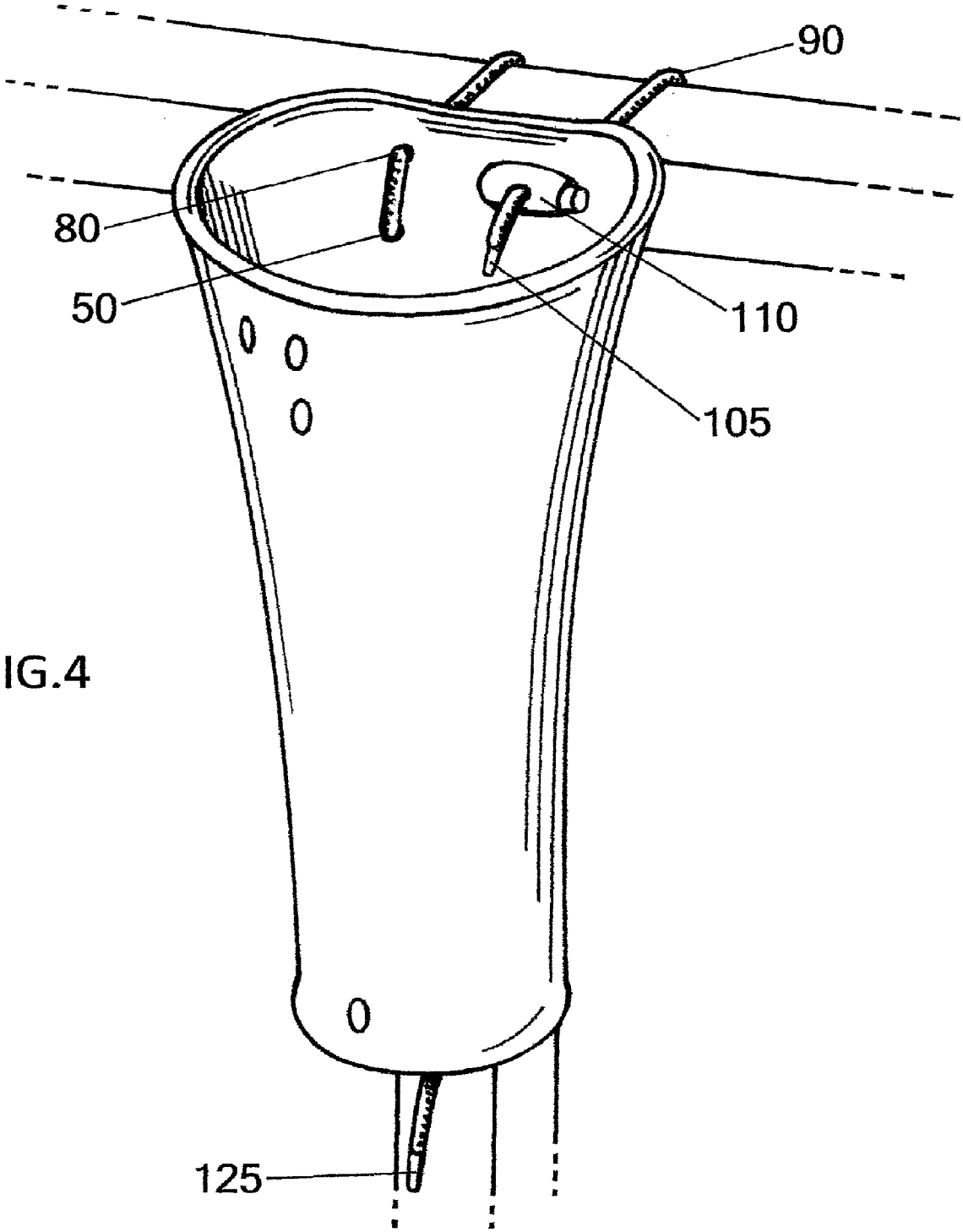
FIG. 4 is a perspective view from an upper rightward frontal position of a third embodiment displayed against both horizontal and vertical suspending elements.
Figure 5:
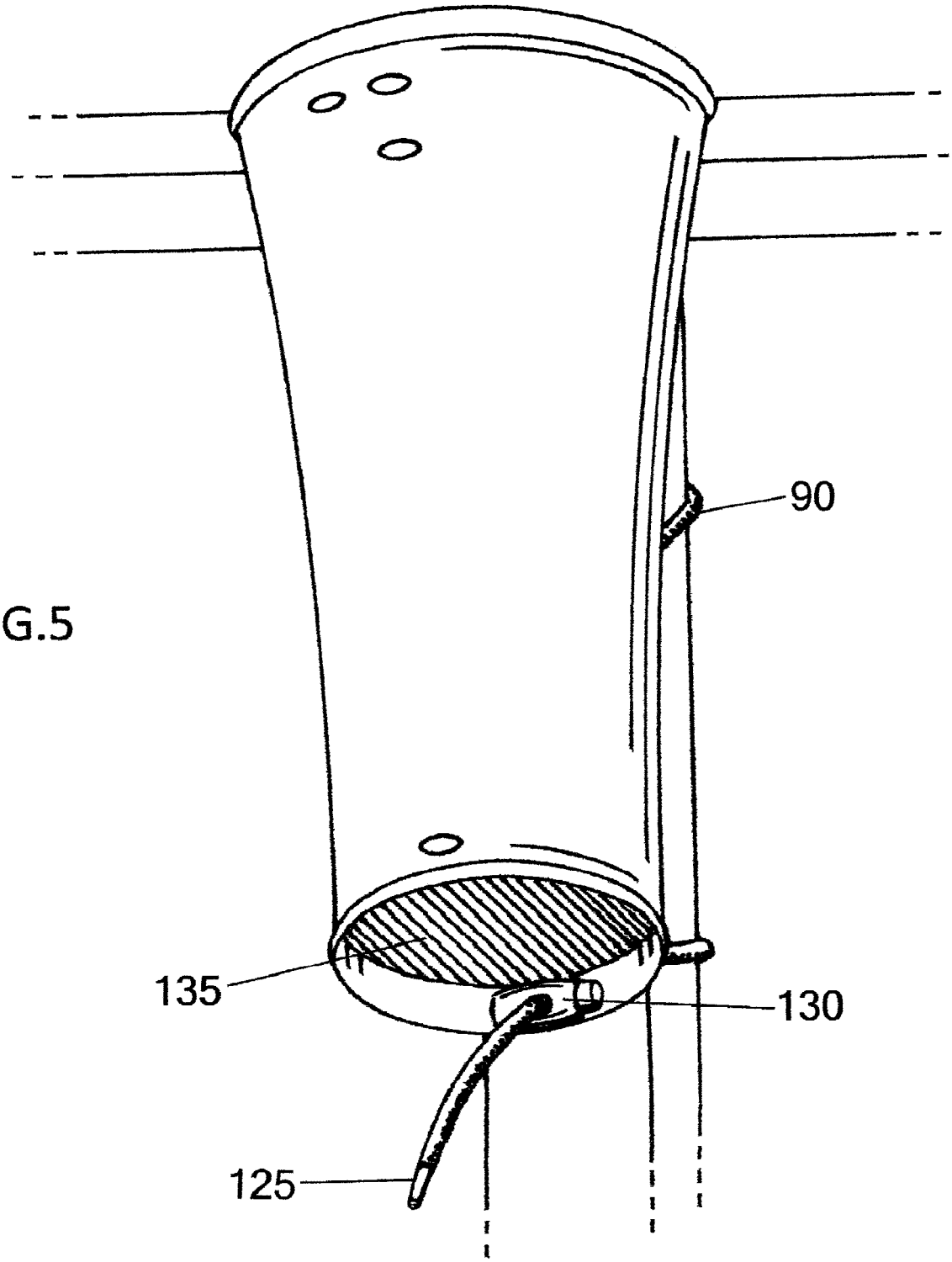
FIG. 5 is a perspective view from a lower rightward frontal position of the embodiment of FIG. 4 displayed against both horizontal and vertical suspending elements.
Figure 6:
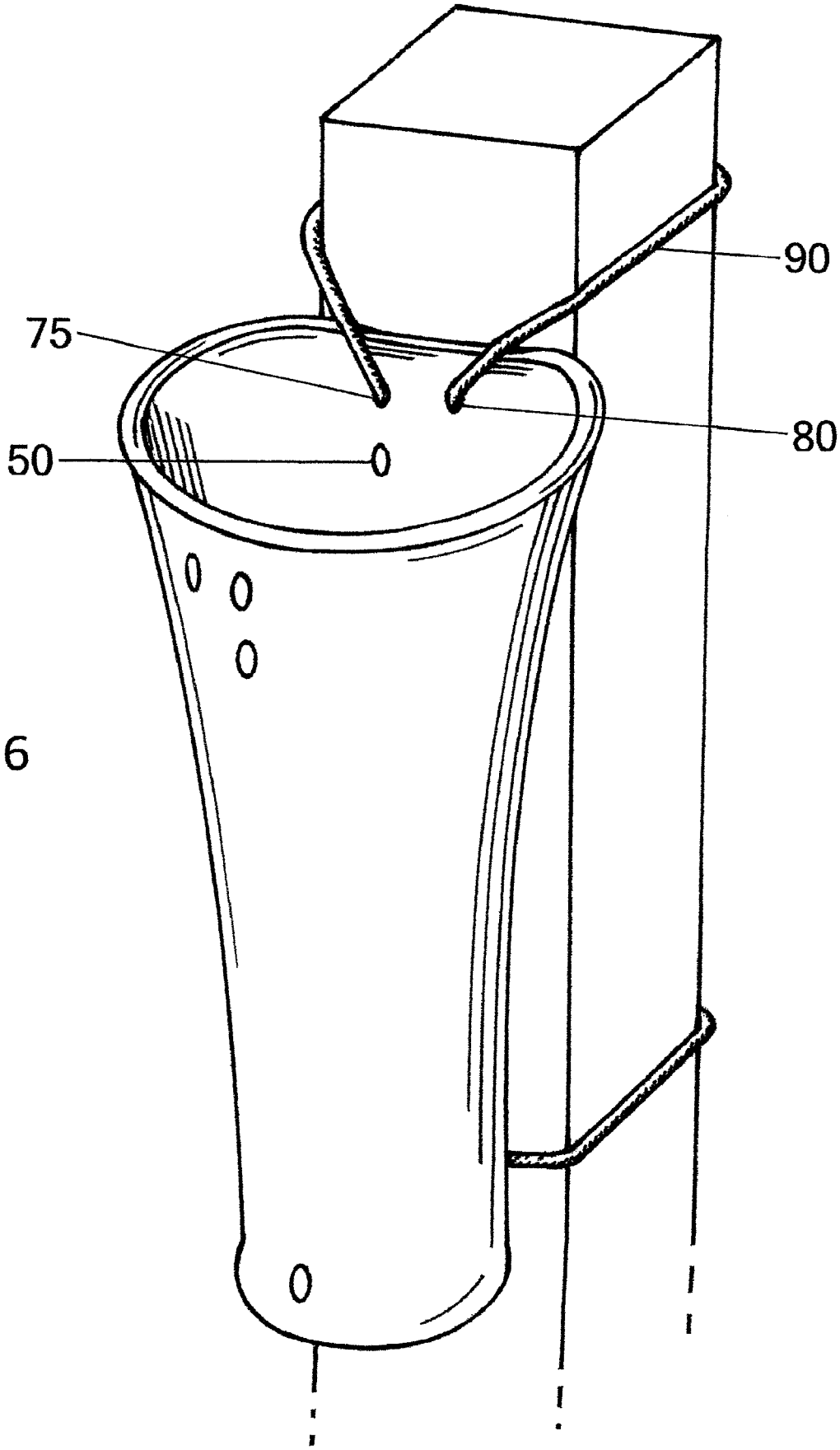
FIG. 6 is a perspective view from an upper rightward frontal position of the embodiment of FIG. 4 displayed against vertical suspending element.

FIG. 4 through 6 depict a third embodiment. The horizontally displaced affixing elements in the top are similar in position to those depicted in FIG. 1. FIG. 4 is a perspective view from an upper rightward frontal position of an embodiment displayed against both horizontal and vertical suspending elements. Both attaching elements were removed from carrying element 90. First attaching element 110 was reattached closer to first actual end 105. Carrying element 90 was passed through fifth affixing element 80 (hidden by first attaching element 110), around a horizontal suspending element, through first affixing element 50 and fourth affixing element 75. Then carrying element 90 was pulled to distort the top 35 to obtain a secure mounting to the horizontal suspending element. Next the carrying element 90 was passed down around the vertical suspending element and into third affixing element 70 (not shown) where it then passed through the second attaching element (not shown) to maintain a secure position. The second actual end (125) is visible.

FIG. 5 is a perspective view from a lower rightward frontal position of the embodiment of FIG. 4 displayed against both horizontal and vertical suspending elements. The second attaching element (130) and the bottom (135) of base 20 are now visible.

FIG. 6 is a perspective view from an upper rightward frontal position of the embodiment of FIG. 4 displayed against vertical suspending element. Both attaching elements were removed from carrying element 90. First attaching element 110 (hidden behind the container top) was reattached closer to first actual end 105 (hidden behind the container top). Carrying element 90 was passed through fifth affixing element 80, around a vertical suspending element, through fourth affixing element 75. Then carrying element 90 was pulled to distort the top 35 to obtain a secure mounting to the vertical suspending element. Next the carrying element 90 was passed down around the vertical suspending element and into third affixing element 70 (not shown) where it then passed through the second attaching element (hidden behind the bottom of the container) to maintain a secure position.

Figure 7:
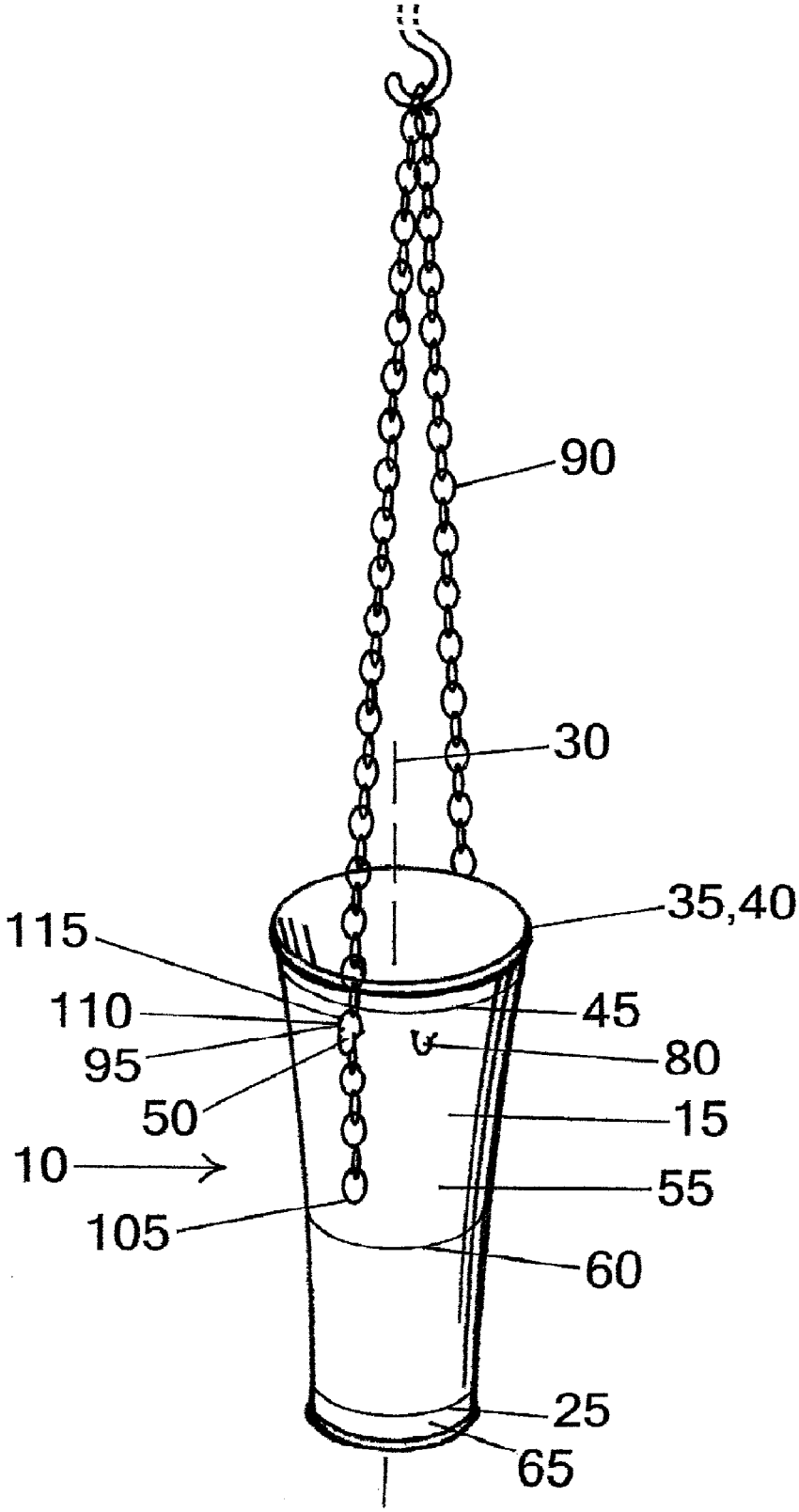
FIG. 7 is a perspective view of a fourth embodiment of the invention as it is hung from a hook.
Figure 8:
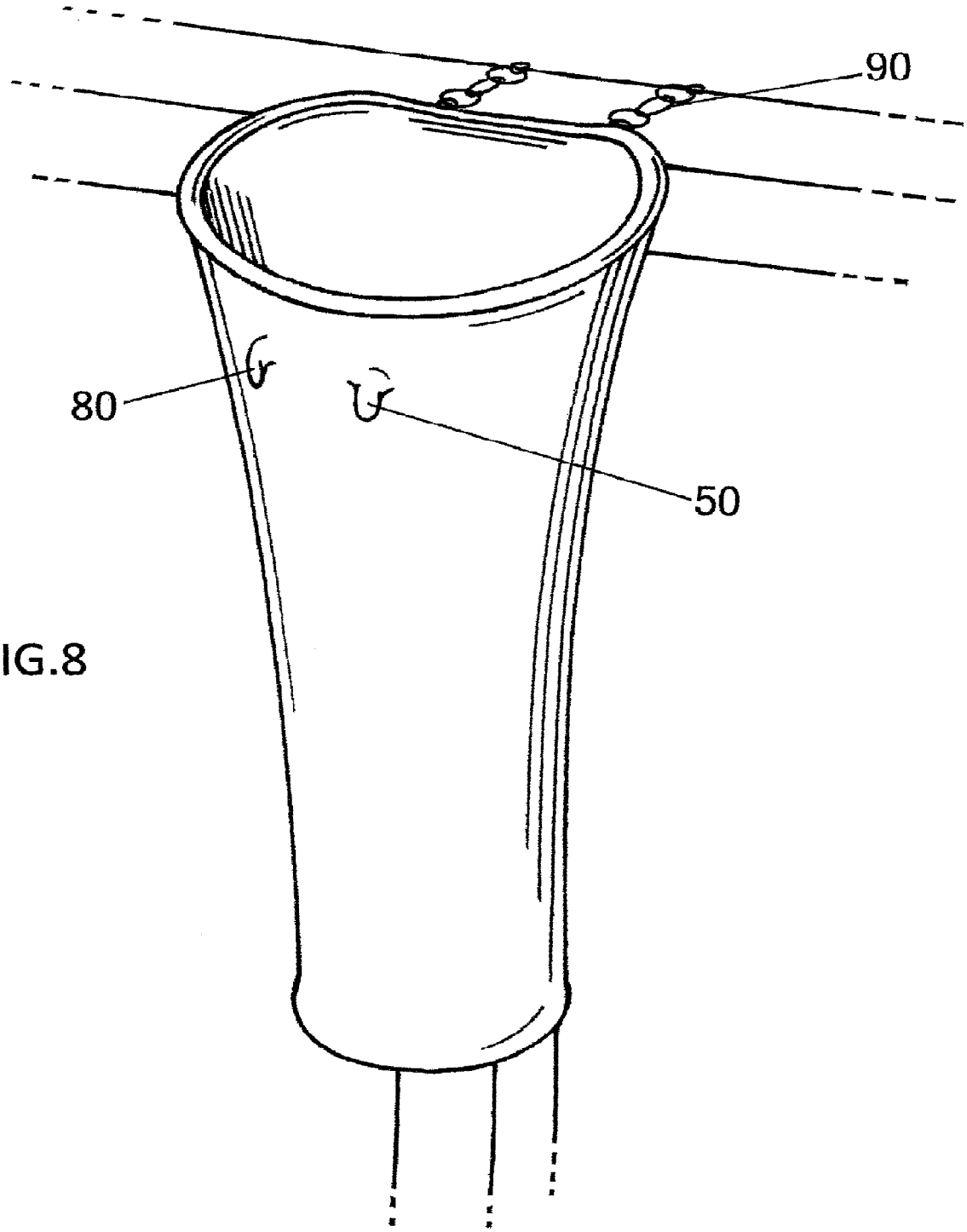
FIG. 8 is a perspective view from a upper rightward frontal position of the embodiment of FIG. 7 displayed against both horizontal and vertical suspending elements.
Figure 9:
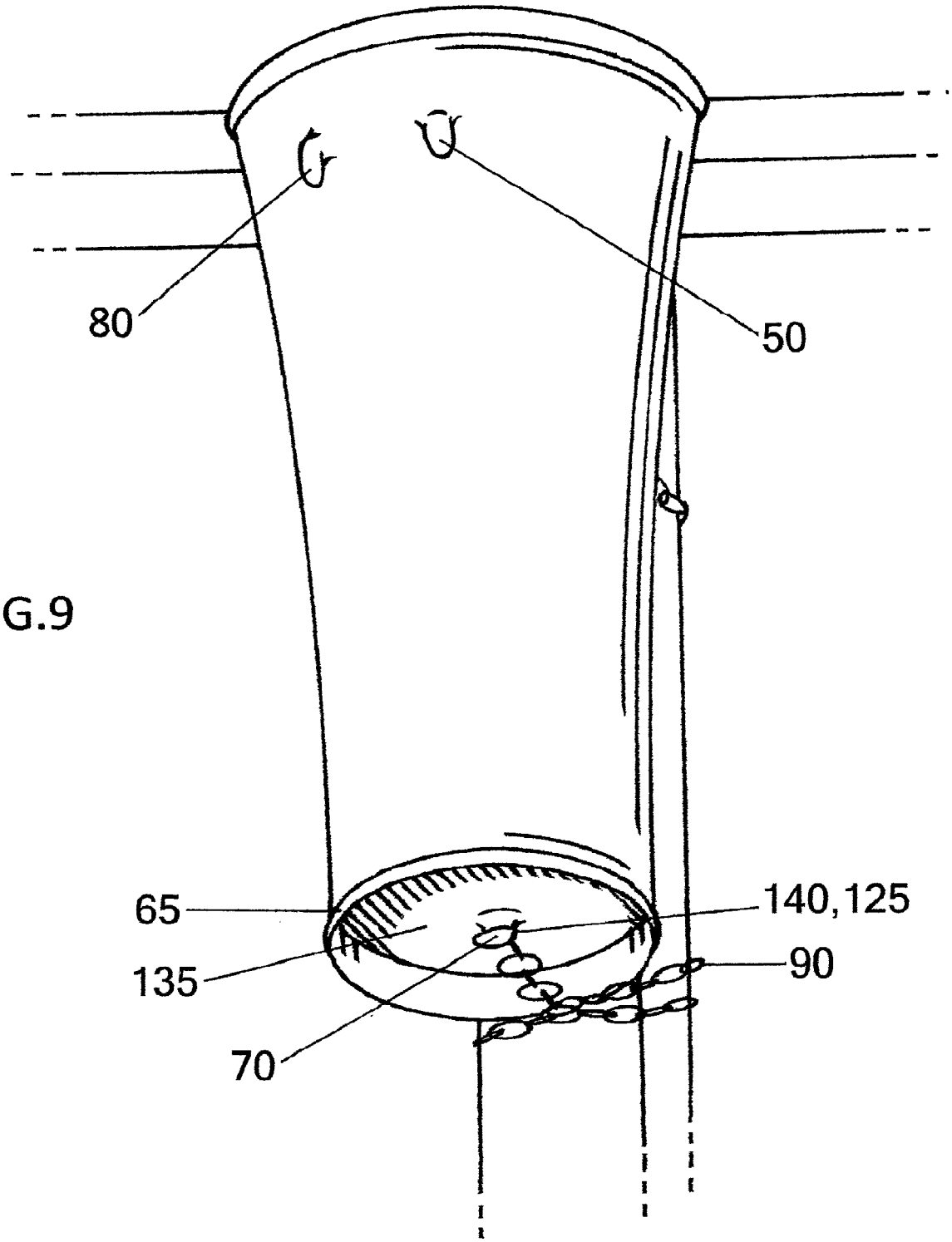
FIG. 9 is a perspective view from a lower rightward frontal position of the embodiment of FIG. 7 displayed against both horizontal and vertical suspending elements.

FIG. 7 through 9 depict a fourth embodiment. FIG. 7 is a perspective view of an embodiment of the invention from the upper front as it is hung from a hanging hook. Container 10 is made of material 15. Base (not seen) has a bottom surface (not seen) and a first horizontal perimeter with axis 30 passing vertically through the center of the shape defined by the perimeter. Top 35 is open, has edge 40, second horizontal perimeter 45 and comprises at least first affixing element 50 (a hook like protrusion) and a second affixing element (hidden by container) substantially equidistant from each other on opposite ends of the perimeter. Sides 55 have third horizontal perimeter 60 that increases between first horizontal perimeter 25 and second horizontal perimeter 45. Bottom member 65 is a rim, affixed to base (hidden by container) and suspended below the bottom surface (hidden by container) of the base. Carrying element 90, a chain, has an adjustable functional length with first functional end 95, a second functional end (hidden by container), first actual end 105 and a second actual end (hidden by container) that extend beyond each end of the functional length. Carrying element 90 also has first attachable element 110, a chain link, between first functional end 95 and first actual end 105 that can be removably attached at various lengths to first affixing element 50 of the top. In addition, carrying element 90 has a second attachable element (hidden by container) between the second end (hidden by container) and second functional end (hidden by container) that is able to be removably attached at various lengths to second affixing element (hidden by container) of top 35. Top 35 also contains a fifth affixing element 80 at least horizontally displaced from and proximate to first affixing element 50. In addition, top 35 contains a seventh affixing element (hidden by container) at least horizontally displaced from and proximate to second affixing element (hidden by container).

FIG. 8 is a perspective view from an upper rightward frontal position of the embodiment of FIG. 7 displayed against both horizontal and vertical suspending elements. Both attaching elements of carrying element 90 were removed from first affixing element 50 and second affixing element 85 (hidden by container). First attaching element 110 (hidden by container) was reattached to first affixing element (hidden by container) at a position closer to first actual end 105 (hidden by container). Top 35 of container 10 was pressed against horizontal suspending element enough to deform the top of the container to secure good contact between the container and the suspending element. Then carrying element 90 was passed over a horizontal suspending element, around a vertical suspending element and over the horizontal suspending element to attach a second attaching element (hidden by container) to second affixing element (hidden by container) to secure the good connection. Next carrying element 90 was passed down around the vertical suspending element and onto third affixing element (hidden by container) where carrying element was securely attached with third attaching element (hidden by container).

FIG. 9 is a perspective view from a lower rightward frontal position of the embodiment of FIG. 7 displayed against both horizontal and vertical suspending elements. The third attaching element (140), third affixing element 70, second actual end 125 of carrying element 90 and bottom 135 of base 20 above rim 65 are now visible.

Figure 10:
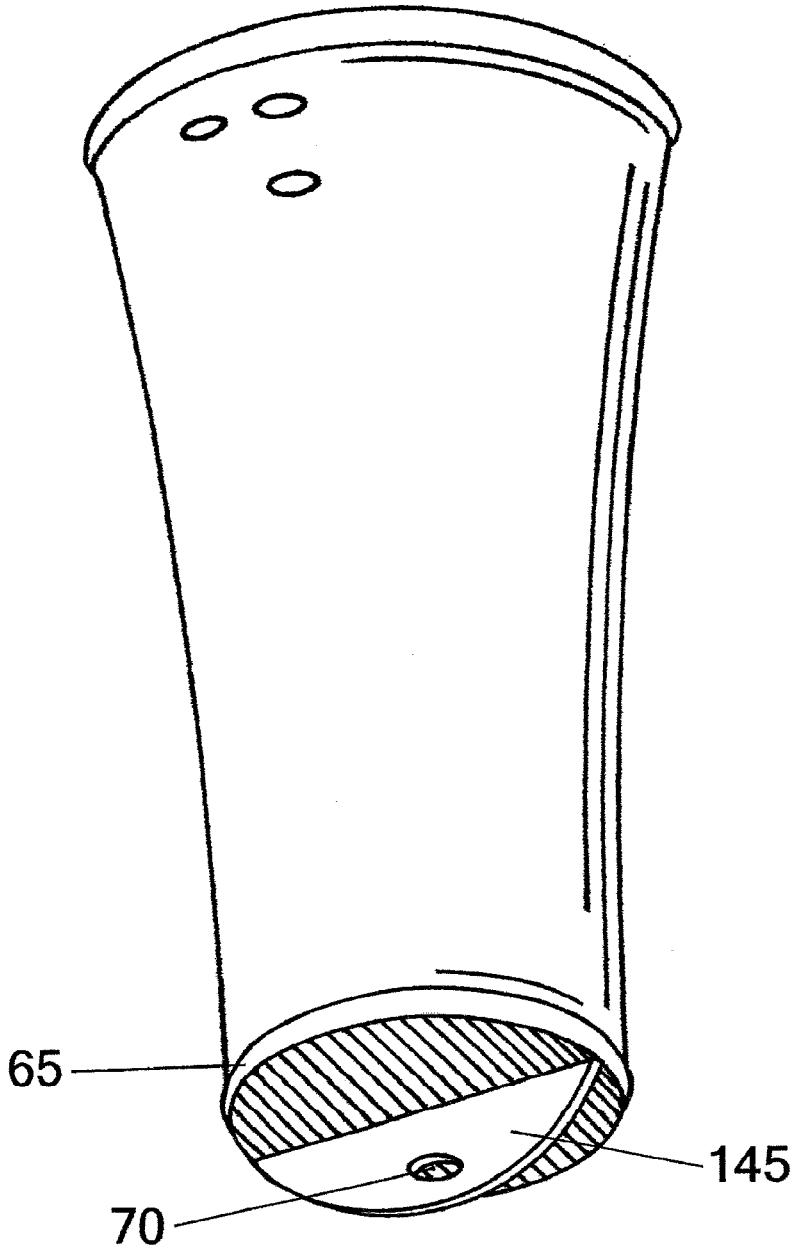
FIG. 10 is a perspective view from a lower rightward frontal position of a fifth embodiment with a flange.

FIG. 10 is a perspective view of a fifth embodiment of my invention from the lower right front where the bottom member is a flange. The embodiment of FIG. 10 is similar to that shown in FIG. 1 except for some differences. The embodiment of FIG. 10 has a straight substantially horizontal top edge 40 and bottom member has both a rim 65 and a flange (145) affixed to bottom 135 of base 20. The flange can be folded up inside the rim to permit the container to be displayed on top of a substantially horizontal surface.

Other modifications and changes regarding my invention will be apparent to those skilled in the art. The invention is not considered limited to the embodiments chosen for purposes of disclosure and covers all changes and modifications that do not constitute departures from the true spirit and scope of this invention.

I claim:

1. A floral container for transporting and displaying cut flowers in water, comprising, a. a material of the container that is substantially deformable, unbreakable, moisture-resistant, weatherproof and dishwasher safe, b. a base having a bottom surface and a first horizontal perimeter with an axis passing vertically through a center of a shape defined by the first horizontal perimeter, c. an open top having an edge and a second horizontal perimeter in a plane proximate the edge, and comprising at least a first and a second affixing element where the first and second affixing elements are substantially equidistant from each other on opposite ends of the second horizontal perimeter, d. sides affixed to the base and top and having a horizontal perimeter ranging in length from a constant between the base and the top to an amount that increases between the base and the top to one that varies in length between the base and top, e. a bottom member affixed to the base and suspended below the bottom surface, and f. a carrying element having an adjustable functional length of between 15 inches and 50 inches with a first functional end and a second functional end, a first actual end and a second actual end are extended beyond each end of the functional length, a first attachable element between the first actual end and the first functional end that is able to be removably attached to the first affixing element of the top and a second attachable element that has two positions, a first position between the second actual end and the nearest functional end that is able to be removably attached at various lengths to the second affixing element of the top, and a second position between a fixing element other than the first affixing element and the second actual end after the carrying element is wrapped around a suspending element to securely place the container against the suspending element.

2. The container of claim 1 wherein the horizontal perimeter is selected from a group consisting of a triangle, square, rectangle, polygon, circle and oval.

3. The container of claim 1 where the bottom member is a lip that extends from the sides below the base, is affixed to the periphery of the base, and has a vertical length, a bottom edge and at least three sections that are substantially equidistant from each other along the first horizontal perimeter of the base.

4. The container of claim 3 wherein the lip is continuous around the first horizontal perimeter of the base and the sections are unified.

5. The container of claim 1 wherein the bottom member has a third affixing element affixed to the bottom member.

6. The container of claim 1 wherein the bottom member has a third affixing element affixed to the bottom surface of the base.

7. The container of claim 1 wherein the affixing elements are protrusions or holes.

8. The container of claim 1 wherein the carrying element is a cord, the attachable elements are repositionable stops and the affixing elements are holes that the carrying element passes through before engaging the attachable elements.

9. The container of claim 1 wherein carrying element is a chain, the attachable elements are chain links and the affixing elements are protrusions acting as hooks.

10. The container of claim 1 wherein the material is silicone polymer.

11. The container of claim 5 wherein the top further comprises a fourth affixing element substantially vertically displaced from and proximate the first affixing element and a fifth affixing element at least substantially horizontally displaced from and proximate the first affixing element.

12. A method for transporting and displaying cut flowers, comprising the steps of, a. providing a container comprising, i. a material of the container that is substantially flexible, unbreakable, weatherproof and dishwasher safe, ii. a base having a bottom surface and a first horizontal perimeter with an axis passing vertically through a center of a shape defined by the first horizontal perimeter, iii. an open top having an edge and a second horizontal perimeter in a plane proximate the edge, and comprising at least a first and at least a second affixing element where the first and second affixing elements are substantially equidistant from each other on opposite ends of the second horizontal perimeter, iv. sides affixed to the base and top and having a horizontal perimeter ranging in length from a constant between the base and the top to an amount that increases between the base and the top to one that varies in length between the base and top, v. a bottom member affixed to the base and suspended below the bottom surface, and vi. a carrying element having an adjustable functional length of between 15 inches and 50 inches with a first functional end and a second functional end, a first actual end and a second actual end are extended beyond each end of the functional length, a first attachable element between the first actual end and the first functional end that is able to be removably attached to the first affixing element of the top and a second attachable element that has two positions, a first position between the second actual end and the nearest functional end that is able to be removably attached at various lengths to the second affixing element of the top, and a second position between a fixing element other than the first affixing element and the second actual end after the carrying element is wrapped around a suspending element to securely place the container against the suspending element, b. placing a selection of cut flowers and at least some water into the container, c. affixing the carrying element to at least the first and second affixing element with the first and second attachable elements to leave a suitable functional length to avoid adversely contacting the flowers while carrying the container by its carrying element, d. transporting the container with cut flowers to a display location, and e. displaying the container with the cut flowers at the display location.

13. The method of claim 12 where the display location has a substantially horizontal surface that the container is set upon.

14. The method of claim 12, further comprising the step of, f. wrapping the carrying element around the suspending element and moving the second attachable element to its second position.

15. The method of claim 12 wherein the bottom member has at least a third affixing element, the carrying element has a third attachable element that is able to be removably attached at various lengths to the third affixing element and the display location has the suspending element, the displaying step of the method further comprises the steps of, (f). removing at least the second end of the carrying element from the second affixing element, (g). wrapping the carrying element at least once around the suspending element, and (h). affixing the carrying element to the third affixing element with the third attachable element to securely hold the container in a desired position.

16. The method of claim 15 wherein the second attachable element and the third attachable element are the same.

17. The method of claim 15 wherein the top further comprises a fourth affixing element substantially vertically displaced from and proximate the first affixing element and a fifth affixing element at least horizontally displaced from and proximate the first affixing element, and the displaying step of the method further comprises the steps of, (i). removing at least the second end of the carrying element from the second affixing element, (j). wrapping the carrying element at least once around the suspending element, and (k). affixing the carrying element to an affixing element other than the first affixing element with the second attachable element to securely hold the container in a desired position.

18. The method of claim 17 where the container is pressed firmly against the suspending element with some distortion of the sides of the container to secure a secure position of the container against the suspending element before step (j).

19. The method of claim 12 wherein vii. the bottom member has a third affixing element, viii. the top further comprises a fourth affixing element substantially vertically displaced from and proximate the first affixing element and a fifth affixing element at least substantially horizontally displaced from and proximate the first affixing element, and ix. the display location has the suspending element, and wherein the displaying step of the method further comprises the steps of, (l). removing at least the second end of the carrying element from the second affixing element, (m). wrapping the carrying element at least once around the suspending element, and (n). affixing the carrying element to the affixing element other than the first affixing element with the third attachable element to securely hold the container in a desired position.

20. The method of claim 19 where the container is pressed firmly against the suspending element with some distortion of the sides of the container to secure a secure position of the container against the suspending element before step (m).

* * * * *